US009149866B2

(12) United States Patent
Epale

(10) Patent No.: US 9,149,866 B2
(45) Date of Patent: Oct. 6, 2015

(54) PROCESS FOR MANUFACTURING A SALT CORE BY ISOSTATIC COMPACTION FOR PARTS IMPLEMENTING SUCCESSIVE FOUNDRY AND FORGING OPERATIONS

(75) Inventor: Romain Epale, Villefranche sur Saone (FR)

(73) Assignee: SAINT JEAN INDUSTRIES, Saint Jean d'Ardieres (FR)

( * ) Notice: Subject to any disclaimer, the term of this patent is extended or adjusted under 35 U.S.C. 154(b) by 0 days.

(21) Appl. No.: 13/997,511

(22) PCT Filed: Dec. 19, 2011

(86) PCT No.: PCT/FR2011/053052

§ 371 (c)(1),
(2), (4) Date: Jul. 30, 2013

(87) PCT Pub. No.: WO2012/085427

PCT Pub. Date: Jun. 28, 2012

(65) Prior Publication Data

US 2013/0299115 A1 Nov. 14, 2013

(30) Foreign Application Priority Data

Dec. 23, 2010 (FR) ..... 10 61116

(51) Int. Cl.
*B22C 9/10* (2006.01)
*B21J 5/00* (2006.01)

(52) U.S. Cl.
CPC . *B22C 9/105* (2013.01); *B21J 5/002* (2013.01)

(58) Field of Classification Search
CPC ..... B22C 9/10; B22C 9/105
USPC ..... 164/37
See application file for complete search history.

(56) References Cited

U.S. PATENT DOCUMENTS 5,941,651 A 8/1999 Di Serio
6,458,297 B2 * 10/2002 Moschini ..... 264/12

FOREIGN PATENT DOCUMENTS

| | | | |
|---|---|---|---|
| EP | 0 119 365 | A1 | 9/1984 |
| EP | 0 586 314 | A1 | 3/1994 |
| EP | 0 850 825 | A2 | 7/1998 |
| WO | 84/04264 | A1 | 11/1984 |
| WO | 2009/050382 | | 4/2009 |

OTHER PUBLICATIONS

English machine translation of EP 0119365.*

* cited by examiner

*Primary Examiner* — Kevin P Kerns
*Assistant Examiner* — Steven Ha
(74) *Attorney, Agent, or Firm* — Seed IP Law Group PLLC

(57) ABSTRACT

A process for manufacturing a salt core to be introduced into a foundry mold by casting of parts made of aluminum, aluminum alloy, or light alloys obtained according to casting operations in order to form a foundry preform. The core is a salt powder and undergoes for its shaping an isostatic compression of the salt powder. The core obtained with the desired shapes is then introduced into the foundry mold to make the form to be obtained, and the shape resulting from the foundry operation is a preform including the salt powder core obtained by isostatic compression. The preform is then forged with its core at a pressure ranging between 600 and 700 MPa to obtain the final form of the product to be obtained, and the core subsequently removed.

13 Claims, 2 Drawing Sheets

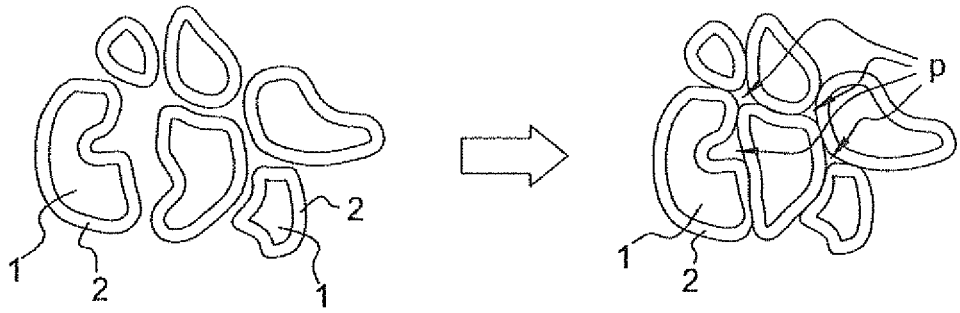
Fig. 1A Fig. 1B
*(Prior Art)*
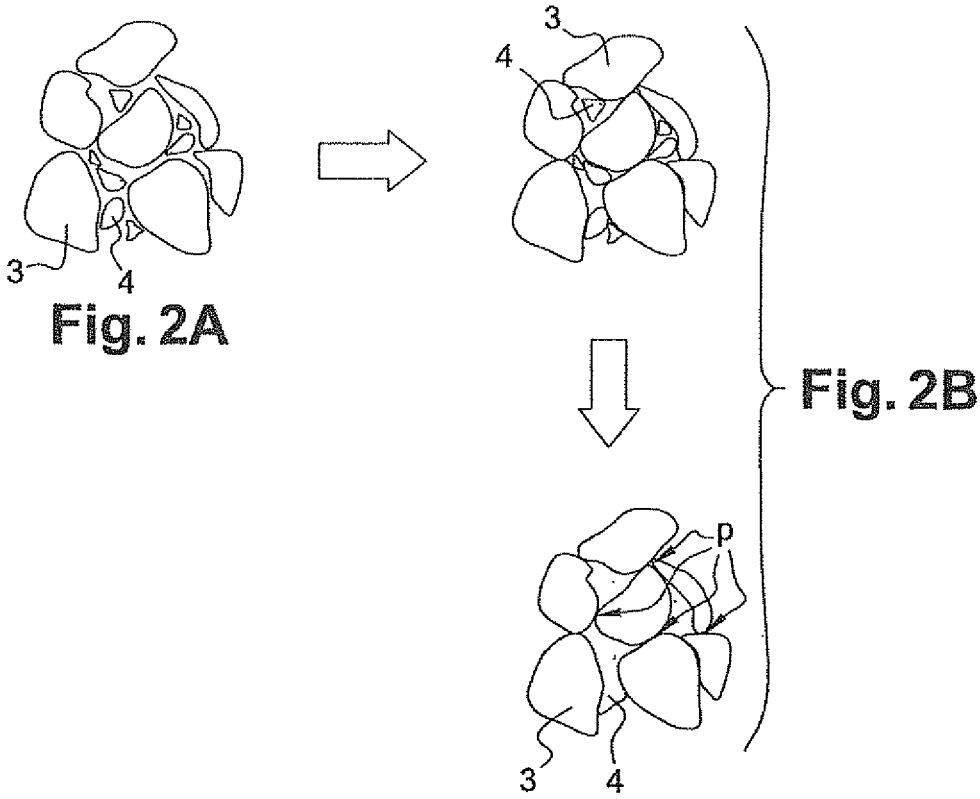
Fig. 2A
Fig. 2B
*(Prior Art)*

PROCESS FOR MANUFACTURING A SALT CORE BY ISOSTATIC COMPACTION FOR PARTS IMPLEMENTING SUCCESSIVE FOUNDRY AND FORGING OPERATIONS

BACKGROUND

1. Technical Field

The present disclosure relates to the technical field of the design of cores for foundry parts to be subsequently forged.

2. Description of the Related Art

The core, in foundry, enables to form hollow shapes in foundry parts. It is generally made of sand or of salt.

For a better understanding of aspects of the invention, the different technologies used to design different types of cores will be briefly reminded, with their limits, in relation with the drawings.

FIGS. 1A-1B show a blown sand core or a blown salt core before and after assembly of the particles.

According to this first implementation, the sand (1) is coated with a bonding agent (2) which hardens on shooting of the core. The sand and the bonding agent are introduced into a nozzle and air is pressurized upstream of this nozzle. The core box is located downstream. The pressure is released and projects the sand into the core box, which may be hot or cold. The sand fills the core box cavity and is set by the bonding agent. The filling of complex shapes is difficult to adjust. Also, in certain cases of use of two sand supply points in the core box, shape and section variations should be limited. However, in this implementation, the sand grains are not deformed and a grain cluster is obtained (FIG. 1B) with porosities (p).

In the case of a blown salt core implementing the same process, the operation takes place in similar conditions, with the same constraints and disadvantages, especially regarding porosity.

Another known solution is that of the sintered salt core illustrated in FIGS. 2A-2B.

In this case, the salt core manufacturing technique comprises a first coining operation followed by a sintering of a mixture of a salt powder with a bonding agent and a mould-release agent. The salt grains are designated with reference (3) and the grain bonds obtained according to the process are designated with reference (4). The coining provides a core which is sufficiently solid to be manipulated. Its solidity is completed after a high-temperature sintering operation. During the sintering, the bonding agent is in a semi-solid or liquid state and fills part of the porosities persisting after the coining.

After cooling, the bonds created by the bonding agent give the core a high breakage resistance but the compressibility remains high since not all porosities (p) are filled. Further, the coining operation results in shape and size limitations to be able to form the core.

The use of the solutions implemented according to prior art thus has limits, with a degree of porosity of the obtained core capable of having adverse effects on casting of the foundry material.

Further, the core obtained according to the previously-mentioned processes, and by their heterogeneous structure, is partially inappropriate for other processing, such as for example a forging operation.

Independently from the foundry core issue, the Applicant is the designer of the COBAPRESS process (registered trademark) defined in European patent 119 365.

This process implements, for aluminum alloys, two successive casting operations to obtain a preform, which is then placed in a forging die to be forged. This technology is very widely exploited and developed by the Applicant, but also by others, since patent EP 119 365 belongs to the public domain.

The Applicant has also developed many improvements to the basic technology of the COBAPRESS process with, for example, the insertion of metal inserts into the preform, which is then forged. This has been defined in patent EP 586 314. The inserts are arranged once and for all in the preform and the final part is obtained.

Unlike foundry cores, inserts cannot be subsequently removed.

There thus is a major obstacle, for the discussed reasons.

In the context of the cast-forged technology, corresponding to the COBAPRESS process, the use of cores has been provided. For example, patent application PCT WO 2009/050382 provides the use of a salt or sand core, formed by means of a cold or hot box or "croning" inserted in a foundry preform to be then submitted to a preform forging operation. In practice, this patent application, which attempts to broaden the core forming mode, essentially refers to a core formed of sand or of resin, which corresponds to the initially-mentioned prior art. This core is actually provided with at least one gas discharge duct to discharge the gases out of the mold during the molding operation. Such gases, according to the Applicant of this patent application, may originate from the combustion of the resins or bonding agents contained in the core. Further, in this document, the gas discharge duct(s) help positioning the core in the mold in the molding operation. This thus generates a very specific structure, with technical constraints associated with this specific implementation and, in particular, specific means for the tightness of the preform blank.

Patent EP 850 825 also discloses the use of a core of lost material to form the hollow portion of a bicycle pedal crank. This core is continued by a support portion used to position the support inside of the foundry mold having the metal cast therein. The ensuing forging operation requires a previous partial removal of the core. This thus requires very specific operations with risks of leaving core fragments in the mold, which may be disturbing and create weak areas during the forging operation.

Patent application WO 84/04264 further discloses the use of salt cores used in foundry molding with a compaction effect (squeeze casting). In this case, the liquid metal is pressurized to 70 MPa as explained by the patentee at page 6, line 30, with a material in the liquid state. This pressure remains very low and does not correspond to a forging pressure, which approximately ranges from 600 to 700 MPa. This document is thus limited to the sole foundry application.

Based on the above considerations, the Applicant has searched for a solution capable of overcoming all the mentioned disadvantages and constraints of prior art.

The Applicant has followed a different approach from previously-described techniques, based on a new concept of foundry core manufacturing design capable of being implemented with no modification of the preform structure for the preform forging operation, and thus of the core surrounded with solid metal at pressures approximately ranging from 600 to 700 MPa.

The solution found and abundantly tested has enabled to validate the Applicant's choice for the manufacturing of this core.

BRIEF SUMMARY

According to a first feature of the invention, the process for manufacturing the salt core to be introduced into a foundry mold by casting of a material known in foundry in order to obtain a preform is remarkable in that the core is a salt powder and undergoes for its shaping an isostatic compression of the salt powder, the core obtained with the desired shapes being then introduced into the foundry mold to make the form to be obtained, and in that the form resulting from the foundry operation is a preform comprising the salt powder core obtained by isostatic compression, said preform being then forged at a pressure ranging between 600 and 700 MPa to obtain the final form of the product to be obtained, and the core being then removed.

The foregoing and other features will appear from the following description.

BRIEF DESCRIPTION OF THE SEVERAL VIEWS OF THE DRAWINGS

Aspects of the invention are illustrated via a non-limiting example in the drawings, where:

FIGS. 1A-1B are views showing the microstructure of a blown salt or sand core before and after assembly according to prior art, FIGS. 2A-2B are views showing the microstructure of a salt core undergoing coining and sintering operations according to prior art.

DETAILED DESCRIPTION

Figures 3A, 3B:
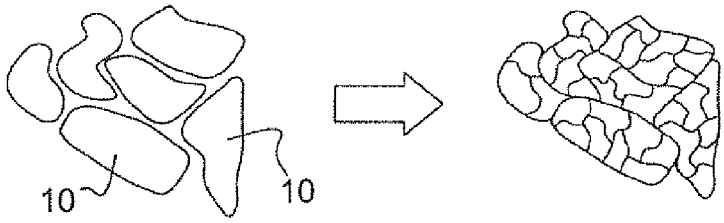
FIGS. 3A-3B are views showing the microstructure of an isostatically compacted salt core according to the invention.

To make aspects of the invention more tangible, it is now described in a non-limiting way illustrated in the drawings.

Referring to FIGS. 3A-3B, the core (10) is made of salt powder. According to the process of an embodiment of the invention, the core is formed by isostatic compression, by introduction of the salt powder into a mold having a very high resilient deformation limit and a very good ability to recover its initial shape after deformation. Once the mold has been filled with salt powder, it is sealed by introducing into an isostatic pressure chamber most often containing a pressure carrier fluid, the vector of this pressure, which may also be a gas. Said enclosure is closed and pressurized. Such a pressure is applied to the salt powder through the mold. The salt powder grains deform, may fragment and eventually cluster up to form a compact assembly free of porosity. The high applied pressure and its homogeneous distribution in the salt powder provides a compact core having a very good cohesion.

The foundry preform thus obtained is thus forged with the salt core compacted by isostatic compression at a pressure ranging from 600 to 700 MPa. The salt core which has been compacted undergoes no volume loss during the forging operation since it is protected by the actual preform and has been compacted with almost no vacuum between the grains forming the core.

The configuration of the core according to aspects of the present invention gives it a very low compressibility. The design of the foundry part which is then forged with the core according to such aspects of the invention is thus eased. The pressing strain during the forging is only used to provide a deviatoric deformation of the core and of the metal, the pressure rise being unaffected by a decrease of the core volume.

According to embodiments of the present invention, the process uses one or several salt powder core(s) obtained by isostatic compaction in the foundry mold.

Figure 4:
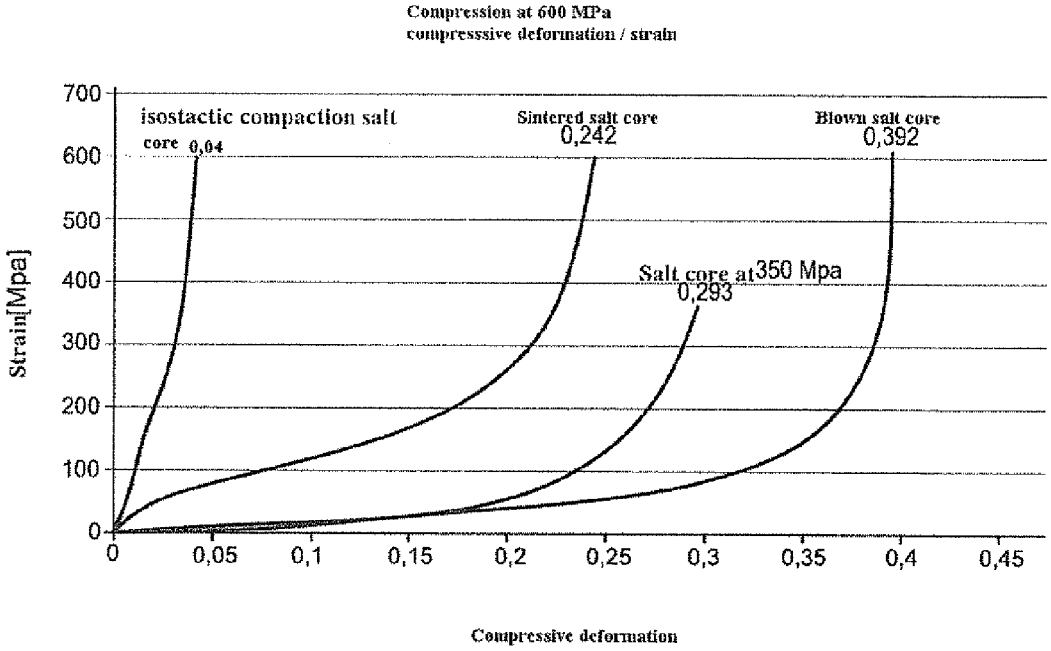
FIG. 4 is a diagram showing according to the compressive strain rate, curves corresponding to cores obtained according to known techniques, blown salt core, blown sand core, sintered salt core and, according to the present invention, isostatic compaction core.

The diagram shown in FIG. 4 highlights core compressibility curves in each known type of implementation reminded hereabove, and according to aspects of the invention. The very clear difference which is obtained with the isostatic compaction salt core with respect to prior art can thus be observed. Essentially, this diagram highlights a specific advantage of the process according to aspects of the present invention over prior art. The compressive deformation of the salt core at a 600-MPa forging pressure has been measured. The isostatic compression deformation rate of the salt core is 4% only, while deformations are 24.2% for a sintered salt core, already 29% for a sand core at a 350-MPa pressure, and 39.2% for a blown salt core.

The Applicant has thus disclosed the use of a salt core in the context of the casting of aluminum or aluminum alloy parts to form a foundry preform, said preform being transported for a forging operation at a pressure ranging from 600 to 700 MPa, the use of a salt core obtained by isostatic compression which has a very low compression deformation during the forging, approximately ranging from 3 to 6%, and more specifically 4%, which enables to more reliably work the outline of parts.

The technical solution implemented in the claimed process with the use of an isostatic compression salt core has an unexpected advantage, very advantageous for the calculation of the features and dimensions of the parts to be obtained with controlled deformations and within a very small variation range (between 3 and 6%, and preferably 4%) with respect to prior art. It should also be specified that the invention requires no bonding agent to manufacture the core by isostatic salt powder compaction. This thus means that there is no need to discharge the bonding agent or the gases originating from the bonding agent combustion as appears in PCT patent WO 2009/050382.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method comprising:

isostatically compacting a salt core;

casting parts made of aluminum or aluminum alloy using the salt core to form a foundry preform;

transporting said foundry preform into a forging die for a forging operation, the salt core being surrounded with solid metal; and forging the foundry preform at a pressure ranging from 600 to 700 MPa.

2. The method of claim 1 wherein, during the forging of the foundry preform, the salt core experiences a compression deformation of between 3% and 6%.

3. The method of claim 2 wherein, during the forging of the foundry preform, the salt core experiences a compression deformation of about 4%.

4. The method of claim 1 wherein the method further comprises removing the salt core from the foundry preform.

5. A method comprising:

forming a core element by isostatic compaction;

introducing the core element into a foundry mold;

casting a preform in the foundry mold such that the preform includes the core element; and forging the preform at a pressure between 600 and 700 MPa.

6. The method of claim 5 wherein the method further comprises, after forging the preform, removing the core element from the preform.

7. The method of claim 5 wherein the core element comprises salt.

8. The method of claim 5 wherein the preform comprises aluminum.

9. The method of claim 5 wherein casting the preform comprises surrounding the core element with a casting material.

10. The method of claim 5 wherein, after casting the preform, the preform comprises a solid metal surrounding the core element.

11. The method of claim 5 wherein, during the forging of the preform, the core element experiences a pressure between 600 and 700 MPa.

12. The method of claim 11 wherein, during the forging of the preform, the core element experiences a compression deformation of between 3% and 6%.

13. The method of claim 12 wherein, during the forging of the preform, the core element experiences a compression deformation of about 4%.

* * * * *